US011970327B2

(12) United States Patent
Rockers

(10) Patent No.: US 11,970,327 B2
(45) Date of Patent: Apr. 30, 2024

(54) INTEGRATED CORNER LOCK ASSEMBLY AND METHODS

(71) Applicant: Veritiv Operating Company, Atlanta, GA (US)

(72) Inventor: Mark Rockers, Mesa, AZ (US)

(73) Assignee: Veritiv Operating Company, Atlanta, GA (US)

( * ) Notice: Subject to any disclaimer, the term of this patent is extended or adjusted under 35 U.S.C. 154(b) by 0 days.

(21) Appl. No.: 17/559,460

(22) Filed: Dec. 22, 2021

(65) Prior Publication Data

US 2023/0055762 A1 Feb. 23, 2023

Related U.S. Application Data

(60) Provisional application No. 63/234,120, filed on Aug. 17, 2021.

(51) Int. Cl.
*B65D 81/05* (2006.01)
*B65D 5/00* (2006.01)
*B65D 5/42* (2006.01)

(52) U.S. Cl.
CPC ..... *B65D 81/057* (2013.01); *B65D 5/0095* (2013.01); *B65D 5/4266* (2013.01); *B65D 5/4279* (2013.01)

(58) Field of Classification Search
CPC .. B65D 81/057; B65D 5/0095; B65D 5/4266; B65D 5/4279; B65D 61/00
USPC ..... 206/586
See application file for complete search history.

(56) References Cited

U.S. PATENT DOCUMENTS 2,670,122 A 2/1954 Davidson et al.
3,349,984 A * 10/1967 Halko, Jr. ..... B65D 81/057 217/52
3,982,682 A 9/1976 Fremion
4,127,192 A * 11/1978 Card ..... B65D 81/057 206/521
4,784,270 A 11/1988 Layer et al.
4,951,821 A * 8/1990 Kempkes ..... B65D 85/54 206/453
5,048,689 A 9/1991 McFarland
7,299,924 B2 11/2007 Robinson, Jr.
(Continued)

OTHER PUBLICATIONS

Corner Protector 5"×5"×1⅜" Depth 9 per Sheet, United Mfrs Suppliers, Available Online at: https://www.unitedmfrs.com/Corner_Protector_p/cc.htm, Accessed from Internet on May 19, 2023, 3 pages.

(Continued)

*Primary Examiner* — Andrew D Perreault
(74) *Attorney, Agent, or Firm* — Kilpatrick Townsend & Stockton LLP

(57) ABSTRACT

Disclosed is a packaging assembly that may include a blank for forming a corner lock. The blank for forming the corner lock may include a first body panel foldably connected to a side panel, a second body panel foldably connected to the side panel, where the first and second body panels may be foldable about the side panel to form a slot within the corner lock in an assembled position. The blank may further include a first and second locking panel foldably connected to the first body panel, and a third and fourth locking panel which may be foldably connected to the second body panel.

22 Claims, 14 Drawing Sheets

(56) References Cited

U.S. PATENT DOCUMENTS 7,424,955 B2 9/2008 Chen

OTHER PUBLICATIONS

Corrugated Corner Protectors, Uline, Available Online at: https://www.uline.com/BL_2160/Corrugated-Corner-Protectors, Accessed from Internet on May 19, 2023, 1 page.

* cited by examiner

INTEGRATED CORNER LOCK ASSEMBLY AND METHODS

CROSS-REFERENCES TO RELATED APPLICATIONS

This application claims the benefit of priority to U.S. Provisional Application No. 63/234,120 titled "INTEGRATED CORNER LOCK ASSEMBLY AND METHODS" and filed Aug. 17, 2021, the entire contents of which is hereby incorporated by reference.

BACKGROUND OF THE INVENTION

Assemblies of protective materials can be used in a wide variety of applications. For example, protective material can be applied to large objects, heavy objects, valuable objects, other suitable objects, or a combination thereof for protection during shipping and installation. Additionally, the protective material can be applied to, or otherwise installed on, suitable objects for moving the objects, storing the objects, or for other suitable purposes. Existing protective material can be difficult to install or otherwise apply. For example, techniques for applying the existing protective material may involve an excessive amount of manpower, time, or effort.

Many businesses rely on online orders and other non-storefront purchases to sell their products. These companies often utilize high-speed packaging processes to package and ship their items as efficiently as possible. However, many conventional packaging means can be costly and time consuming to apply to a product for sale, which can delay the shipment of goods or require a larger workforce to process the same number of shipments.

In other circumstances, individuals and families are increasingly mobile, as many tend to change their living arrangements on an annual or semi-annual basis. Both for moving companies and individuals moving themselves, the process of packaging and protecting valuables and other objects can be time-consuming and difficult.

BRIEF SUMMARY OF THE INVENTION

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this application, and any or all drawings or figures.

Disclosed are assemblies of protective material that include integrated corner locks that can be formed from a unitary blank and can be used with one or more components to protect at least a portion of a product. Assemblies according to aspects of the present disclosure can include at least one integrated corner lock. The integrated corner lock may include a slot that can receive the one or more linear components. The integrated corner lock may include one or more flaps that may apply a retention force on the one or more linear components. The integrated corner lock can be efficiently installed on an item and may be retained in place without the use of adhesive or other locking features.

Implementations of the present disclosure are related to a packaging assembly including a blank for forming a corner lock in an assembled position, a blank for forming a linear component in an assembled position, and methods of use of the same. While one of such components may be described in detail herein, it will be appreciated that a given assembly may include a plurality of blanks for forming corner locks, and/or a plurality of blanks for forming linear components.

BRIEF DESCRIPTION OF THE DRAWINGS

The features and components of the following figures are illustrated to emphasize the general principles of the present disclosure. Corresponding features and components throughout the figures can be designated by matching reference characters for the sake of consistency and clarity.

DETAILED DESCRIPTION OF THE INVENTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Figure 1:
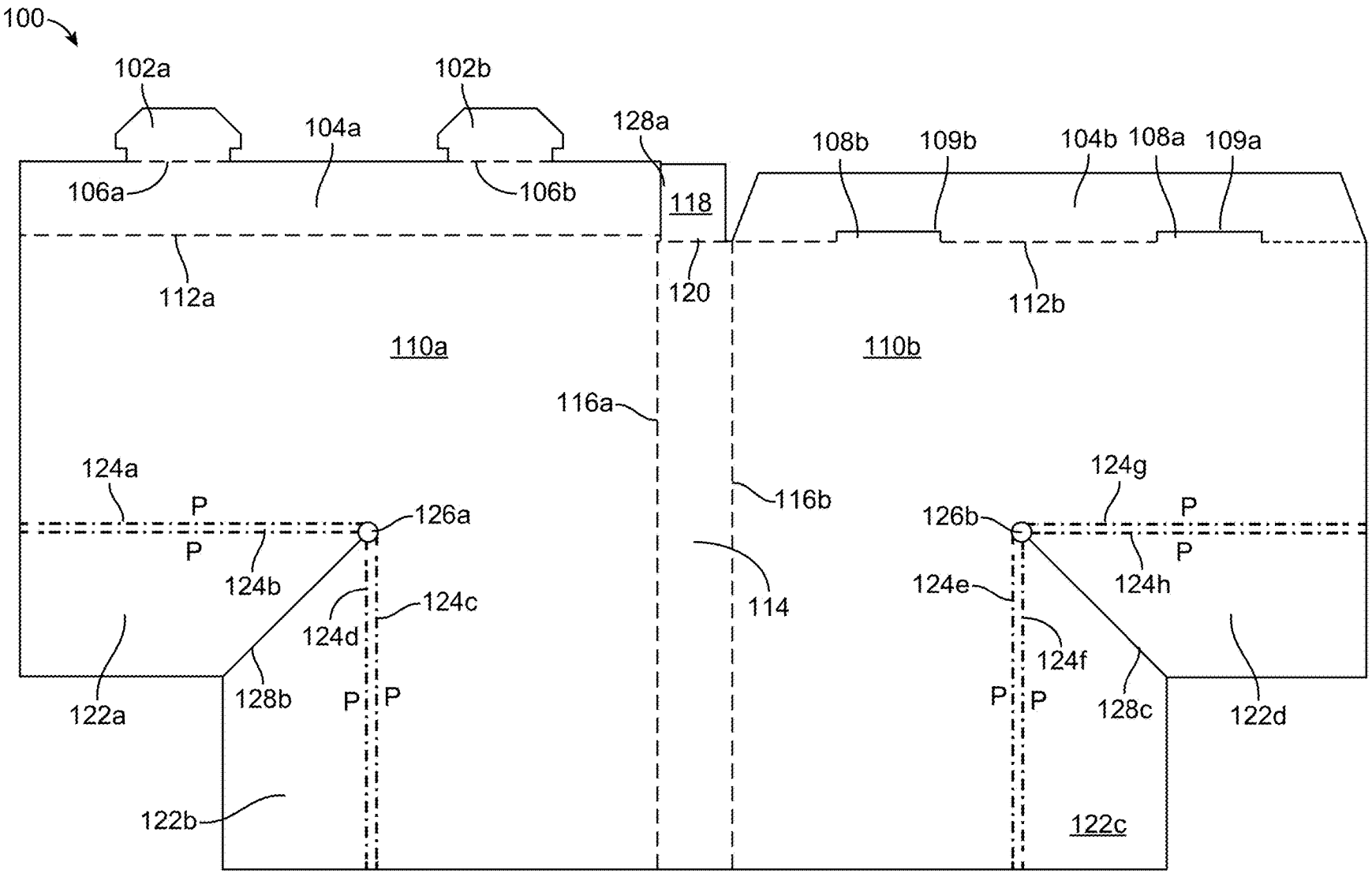
FIG. 1 is a plan view of an embodiment of a unitary blank of a foldable material that may be folded to form an integrated corner lock of a protective assembly.

Referring now to the drawings for a better understanding of the invention, FIG. 1 illustrates a unitary blank 100 of foldable material. The foldable material can include or be made of corrugated cardboard, although other materials may be used if desired. For example, in some embodiments, the foldable material can include corrugated cardboard, injection-molded plastic, shaped or formed foam, hexacombs, other suitable materials, or a combination thereof. The various elements of the assembly of protective material can comprise the same or different material.

FIG. 1 illustrates one example of the unitary blank 100 from which an integrated corner lock for an assembly of protective material may be formed. In the drawing of the unitary blank 100, solid lines indicate cut lines and evenly dashed lines indicate fold lines. The drawing also includes cut and crease lines having a series of cuts separated by creases shown as dash-dot-dash lines. In some embodiments, the cut and crease lines have cuts that are ¼ inch long separated by creases that are ¼ inch long, although cuts and creases of various lengths could be used. Each of these lines are described in further detail below. Although the blanks include exemplary dimensions, the dimensions are not intended to be limiting, and other dimensions may be used without departing from the scope of the invention. Additionally, the various panels, flaps, cut lines, fold lines, cut crease lines, openings, etc. can have any suitable dimensions.

As illustrated in FIG. 1, the unitary blank 100 can include tabs 102*a,b*. The tabs 102*a,b* can be foldably connected to a flap 104*a* at fold lines 106*a,b*, respectively. The unitary blank 100 can additionally include a flap 104*b* that can include tab inserts 108*a,b*, which may be formed via cut lines 109*a,b*. In response to folding the unitary blank 100, the tabs 102*a,b* can be inserted into the tab inserts 108*a,b*, respectively, and can help retain the unitary blank 100 in a folded configuration as described further below. The flaps 104*a,b* can be foldably connected to body panels 110*a,b* at fold lines 112*a,b*, respectively. The body panels 110*a,b* can be foldably connected to a side panel 114 at fold lines 116*a,b*, respectively. The unitary blank 100 can include a side flap 118 that can be foldably connected to the side panel 114 at a fold line 120. The side flap 118 can be separated from the flap 104*a* via cut line 128*a*. The cut line 128*a* can additionally allow the flap 104*a* and the side flap 118 to be independently folded.

The unitary blank 100 can additionally include locking panels 122*a-d*. The locking panel 122*a* can be foldably connected to the body panel 110*a* at score lines 124*a,b*. The locking panel 122*a* can be separated from the locking panel 122*b* by cut line 128*b*. The cut line 128*b* can additionally allow the locking panel 122*a* and the locking panel 122*b* to be independently folded. The locking panel 122*b* can be foldably connected to the body panel 110*a* at score lines 124*c,d*. The locking panel 122*c* can be foldably connected to the body panel 110*b* at score lines 124*e-f*. The locking panel 122*d* can be foldably connected to the body panel 110*b* at score lines 124*g-h*. The locking panel 122*d* can be separated from the locking panel 122*c* via cut line 128*c*. The cut line 128*c* can additionally allow the locking panel 122*c* and the locking panel 122*d* to be independently folded. The score lines 124*a,b* can be separated from the score lines 124*c,d* by a cutout 126*a* that can be removed from the unitary blank 100 during assembly. The score lines 124*e-f* can be separated from the score lines 124*g-h* by a cutout 126*b* that can be removed from the unitary blank 100 during assembly. The score lines 124*a-h* can include one or more perforations, cuts, creases, or a combination thereof. For example, as illustrated in FIG. 1, the score lines 124*a-h* each include perforations approximately every ¼ inch (e.g., a ¼ inch cut followed by a ¼ inch crease, repeatedly, etc.). The perforations can be located along the score lines 124*a-h* in any suitable configuration.

Figure 2A:
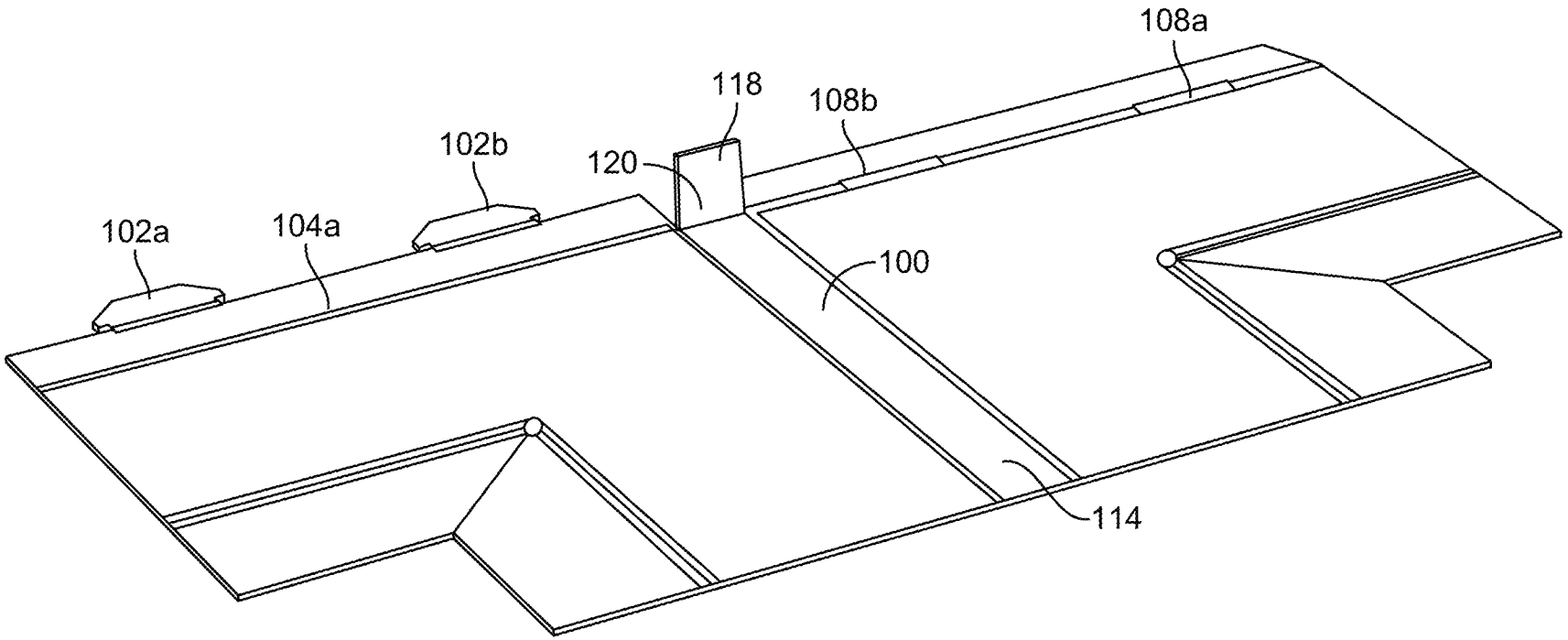
FIGS. 2A-2F are a set of perspective views that illustrate folding steps to assemble the unitary blank of FIG. 1 to form the integrated corner lock.
Figure 2B:
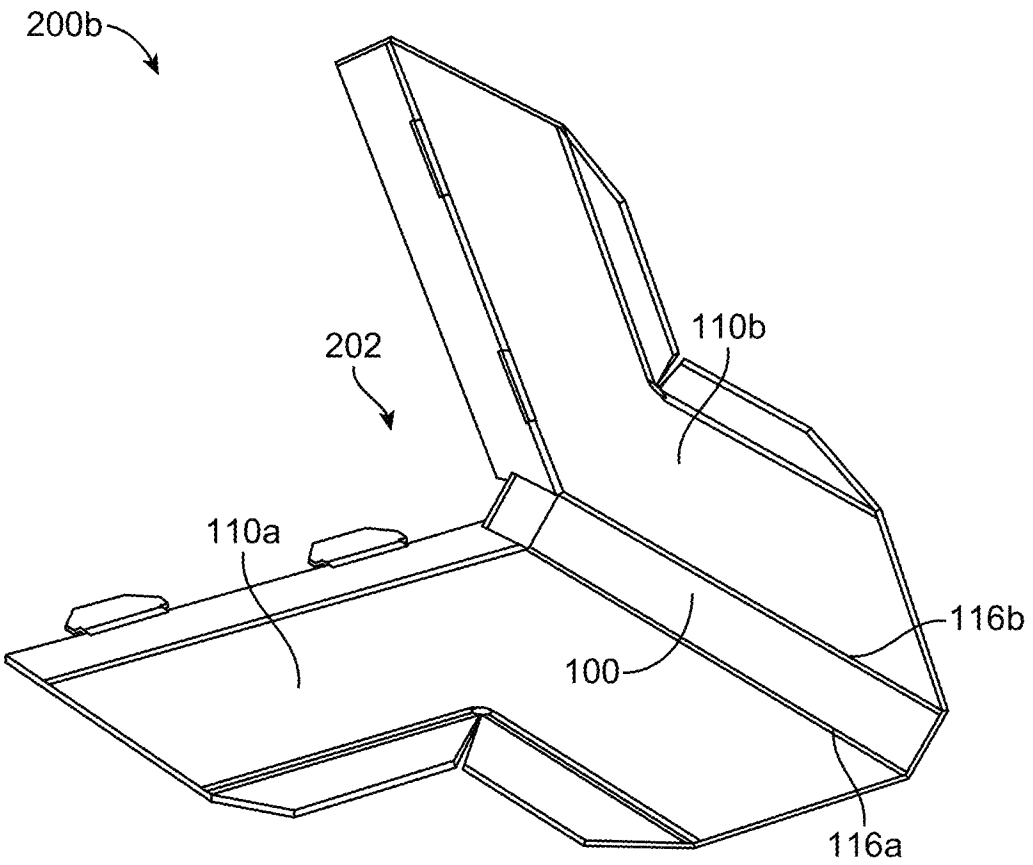

FIGS. 2A-2E illustrate a method of folding a unitary blank, for example, the unitary blank 100, into an integrated corner lock 150 for use in an assembly of protective material. For example, as illustrated in FIG. 2A, the side flap 118 can be folded along the fold line 120 adjacent to the side panel 114 and away from the flap 104*a*. The illustrated folding operation can cause the side flap 118 to form substantially a right angle with the side panel 114. As illustrated in FIG. 2B, folds can be made along the fold lines 116*a,b* to position the body panel 110*b* opposite the body panel 110*a* to form a slot 202. Additionally, based on the folding operation depicted in FIG. 2A, the side flap 118 can be positioned in the slot 202.

Figure 2C:
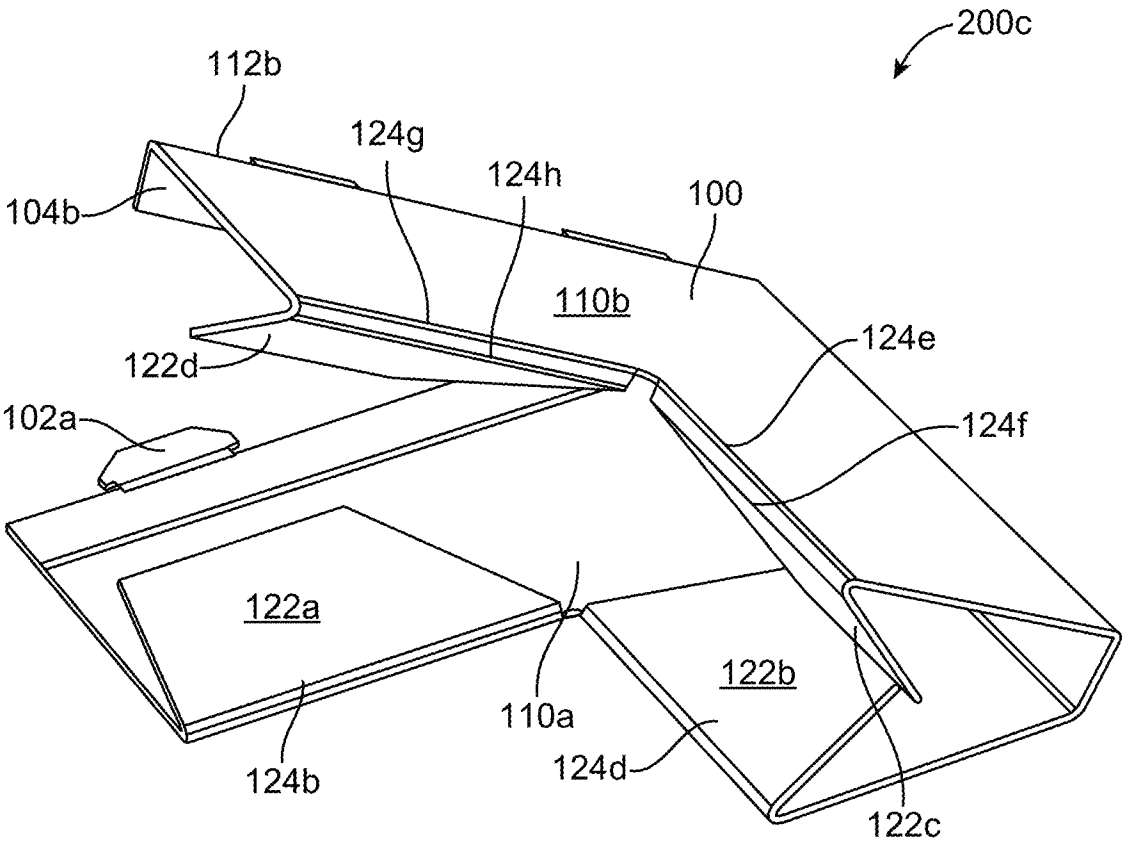

As illustrated in FIG. 2C, the locking panels 122*d* and the flap 104*b* can be folded towards the body panel 110*b* at the score lines 124*g-h* and the fold line 112*b*, respectively. Similarly, the locking panel 122*c* can be folded along the score lines 124*e-f* towards the body panel 110*b*. The locking panel 122*b* can be folded along the score lines 124*c,d* towards the body panel 110*a*. The locking panel 122*a* can be folded along the score lines 124*a,b* towards the body panel 110*a*. In response to the described folding operations, the locking panel 122*a* can be positioned opposite the locking panel 122*d* with respect to the slot 202 and, the locking panel 122*b* can be positioned opposite the locking panel 122*c* with respect to the slot 202. Additionally, the tab inserts 108*a,b* can be opened or otherwise positioned to receive the tabs 102*a,b*.

Figure 2D:
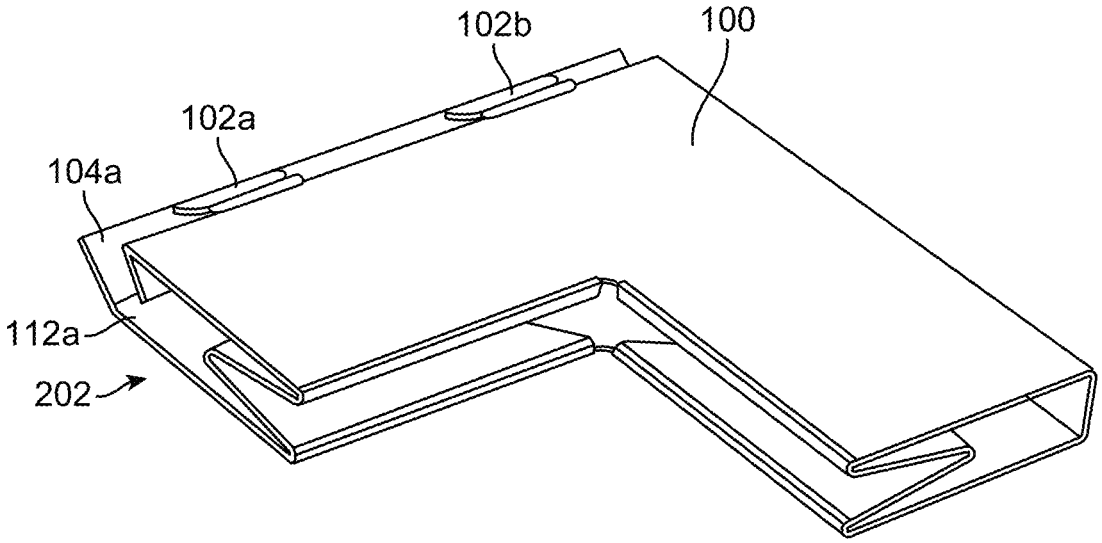
Figure 2E:
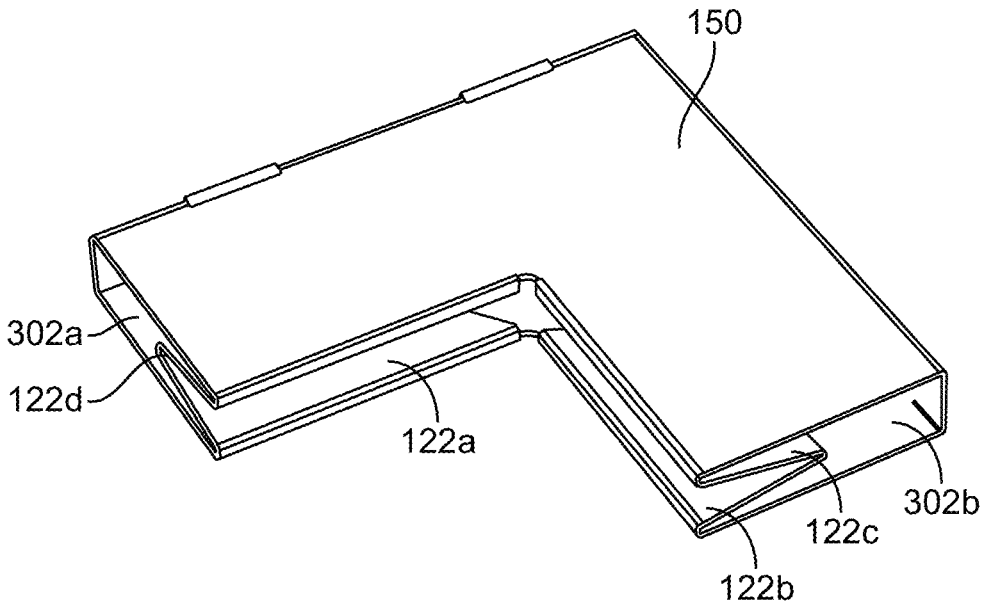

As illustrated, FIG. 2D includes a perspective view of the unitary blank 100 after the folding operations depicted in FIG. 2C. As illustrated in FIG. 2D, the flap 104*a* can then be folded along the fold line 112*a* to position the flap 104*a* adjacent or otherwise proximate to the flap 104*b*. Additionally, the tabs 102*a,b* can be folded along the fold lines 106*a,b*, respectively for insertion into the tab inserts 108*a,b*, respectively. Inserting the tabs 102*a,b* into the tab inserts 108*a,b* can secure the unitary blank 100 in its assembled form (e.g., shown in FIGS. 2E-2F) where it acts as the corner lock 150. In other words, the unitary blank 100 may be assembled from its lay-down-flat position (e.g., illustrated in FIG. 1) to an assembled position (e.g., illustrated in FIGS. 2E-2F) to form the corner lock 150, which may be used in various protective packaging applications. FIG. 2E is a perspective view of the unitary blank 100 assembled into the corner lock 150, and FIG. 2F depicts the unitary blank 100 assembled into the corner lock 150 from an alternate view.

Figure 2F:
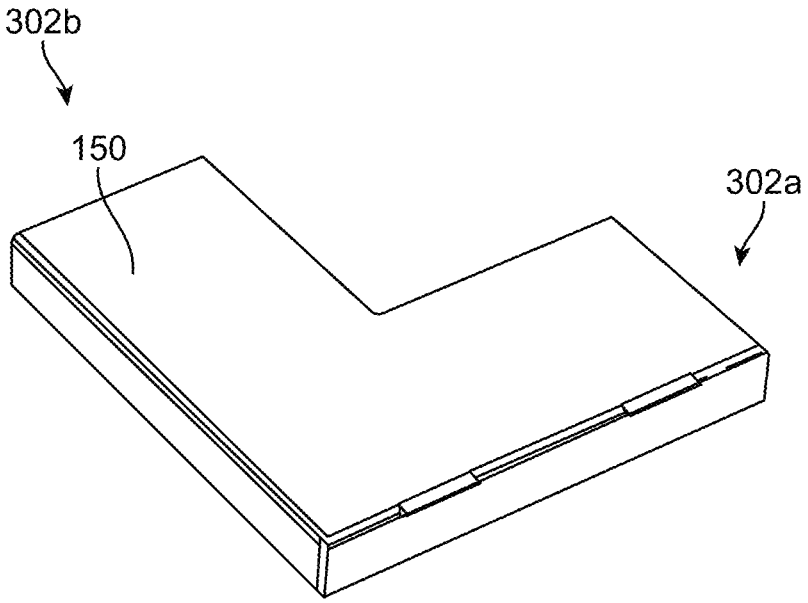

As illustrated in FIGS. 2E-2F, the slot 202 defined in the corner lock 150 (shown in FIG. 2B-2D) can be further defined as two insertion slots 302*a,b*. The insertion slots 302*a,b* are defined by the space between the body panels 110*b* and 110*a*. The insertion slots 302*a,b* can be sized and shaped to receive one or more linear portions or linear components, which, when assembled together with the corner lock 150, forms an assembly of protective material for protecting an item during manufacturing, shipment, and/or installation.

Figure 3A:
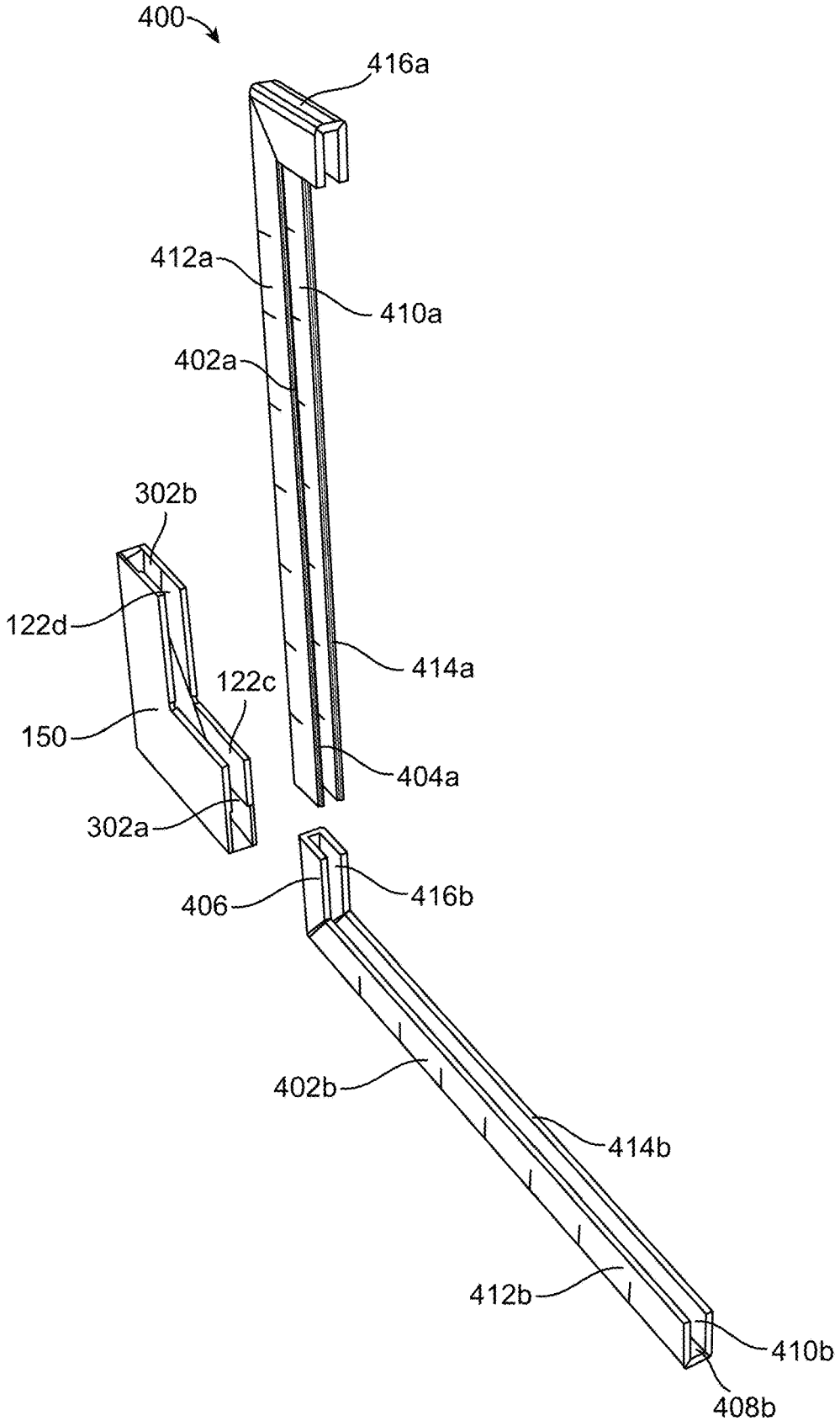
FIGS. 3A-3B are a set of perspective views of an embodiment of an assembly of protective material including the integrated corner lock of FIGS. 1-2.
Figure 3B:
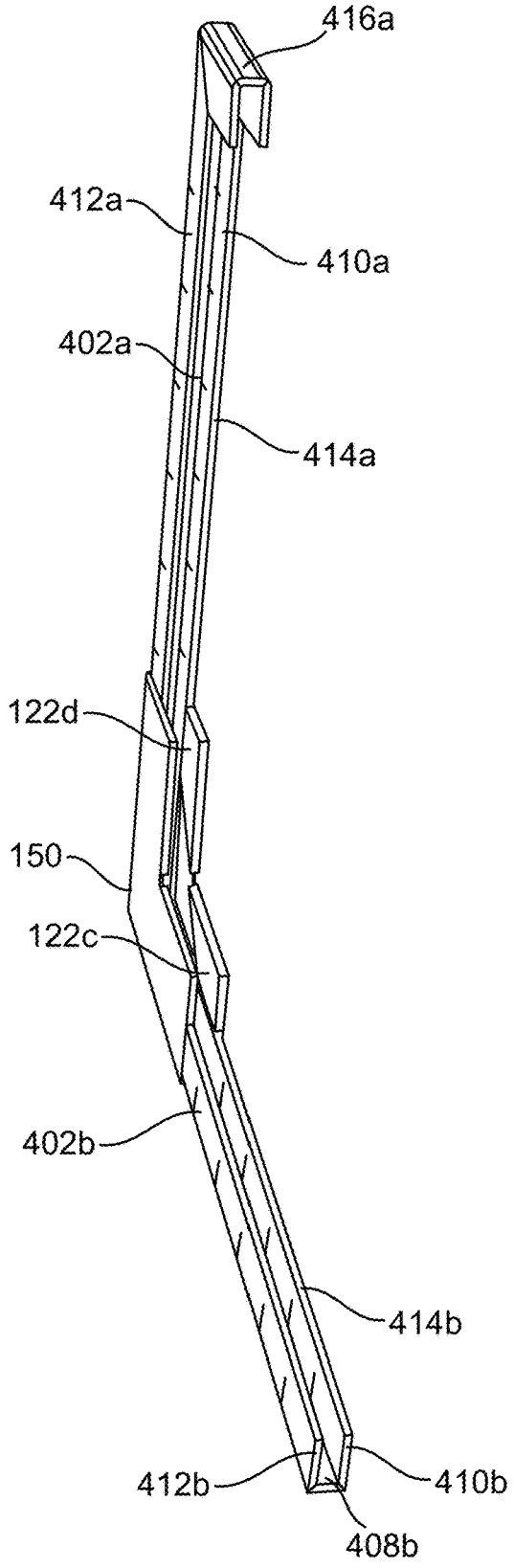

As illustrated in FIGS. 3A-3B, one or more linear components 402*a,b* may be inserted in the insertion slots 302*a,b* for forming an assembly of protective material 400.

In some embodiments, the linear components 402*a,b* can in some aspects have a U-shape cross-section and may be an elongated piece comprising the same or different material as the corner lock 150. The linear components 402*a,b* may include an elongated panel 408*a,b*, a first side panel 410*a,b* foldably coupled to a first side of the elongated panel 408*a,b*, and a second side panel 412*a,b* foldably coupled to a second side of the elongated panel 408*a,b*. For example the first and second side panels may be coupled to opposite sides of the elongated panel 408*a,b*, such that the first and second panel are parallel to each other on opposite sides of the U-shape cross-section. the elongated panel 408*a,b* may have a width sized for being received within one or both of the insertion slots 302*a,b*.

The linear components 402*a,b* may be sized and shaped to fit snuggly within the insertion slots 302*a,b*, such that the linear components 402*a,b* are retained in place at least in part due to frictional engagement between the linear components 402*a,b* and the body panels defining the insertion slots 302*a,b*. The inward biasing of the locking panels 122*a-d* can aid in retaining the corner lock 150 in place on a product sought to be protected by the assembly of protective material. For example, an edge of a product (e.g. a door, a window, etc.) can be received within the corner lock 150 and may also be received by the linear components 402-*b* such that the locking panels 122*a-d* can press against the product and aid in retaining the corner lock 150 and linear components 402*a,b* in place on the product, respectively. The locking panels 122*a-d* may also aid in retaining the linear components 402*a,b* in place within the insertion slots 302*a,b*, respectively, via frictional engagement between a surface (e.g. an edge surface or side surface) of the locking panels 122*a-d* and the sides 410*a,b*, 412*a,b* of the linear components 402*a,b*. For example, a bottom edge surface of each of the locking panels 122*b-c* can contact a top edge surface of the sides 410*a,b*, 412*a,b* for aiding in retaining the linear component 402*b* in place within the corner lock 150. Similarly, the locking panels 122*a-d* can be biased towards the insertion slot 302*b* for aiding in retaining the linear component 4002*a* in place within the insertion slot 302*b* via frictional engagement between a side surface of the locking panels 122*a*, 122*d* and a surface of the linear component 402*a*. In still yet other embodiments, the locking panels 122*a-d* may not contact the linear components 402*a,b* during assembly and may act as a stopper to prevent the linear components 402*a,b* from disengaging with or falling out of the corner lock 150. In still yet other embodiments, the locking panels 122*a-d* may contact the sides 410*a,b*, 412*a,b* of the linear components 402*a,b*.

For use as an assembly of protective material 400, the linear components 402*a,b* can be inserted into, or otherwise positioned in, the corner lock 150. For example, a first end 404 of the linear component 402*a* can be positioned in the insertion slot 302*b* of the corner lock 150, and a first end 406 of the linear component 402*b* can be positioned in the insertion slot 302*a* of the corner lock 150. Once the linear components 402*a,b* are positioned in the corner lock 150 (e.g., illustrated by FIG. 3B), the insertion slots 302*a,b* may aid in retaining the linear components 402*a,b* in place by applying retention forces (e.g., via the locking panels 122*a-d*) on the linear components 402*a,b*, this may aid in preventing accidental disassembly of a protective material assembly that includes the corner lock 150 and the linear components 402*a,b*.

In some embodiments, a portion of the linear component may be angled as compared to the remainder of the linear component. For example the first end 406 of the linear component 402*b* may include a corner section 416*b* foldably coupled to the first end 406, which is angled with respect to the remainder of the linear component 402*b* when in the assembled position (e.g., as illustrated in FIG. 3A). In some aspects, this may aid in retaining the linear component in place within the corner lock 150. For example, the linear component 402*b* may include a corner section 416*b* at the first end which angles from the remainder of the linear component 402*b* such that the corner section 416*b* corresponds to the shape of the corner lock. As shown in FIG. 3A, the first end 406 may include a corner section 416*b* which is angled at about 90 degrees, such that when the linear component 402*b* is inserted (or otherwise placed) in the corner lock 150, the angle of the corner section 416*b* corresponds with the angle of the corner lock 150. This advantageously provides a frictional connection with additional surface area within the insertion slot 302*a*. Other angles (larger or smaller than 90 degrees) may also be used which correspond with one another, depending on the desired shape of the packaging assembly.

As illustrated in FIG. 3A, the linear components 402*a,b* may be dimensioned to correspond with one another when positioned within the corner lock 150. For example, as discussed, linear component 402*b* may be angled at the first end 406 to correspond with the shape of the insertion slots 302*a,b*. As such, linear component 402*a* may not include an angled portion to allow for the first end 404 of the linear component 402*a* to align with the angled first end 406 of linear component 402*b*. Thus, the first end 404 may match the dimension and angle of the first end 406 of linear component 402*b*. Such a design may provide for maximum stability of the linear components 402*a,b* within the corner lock 150 by providing physical contact between all of the components.

Figure 4A:
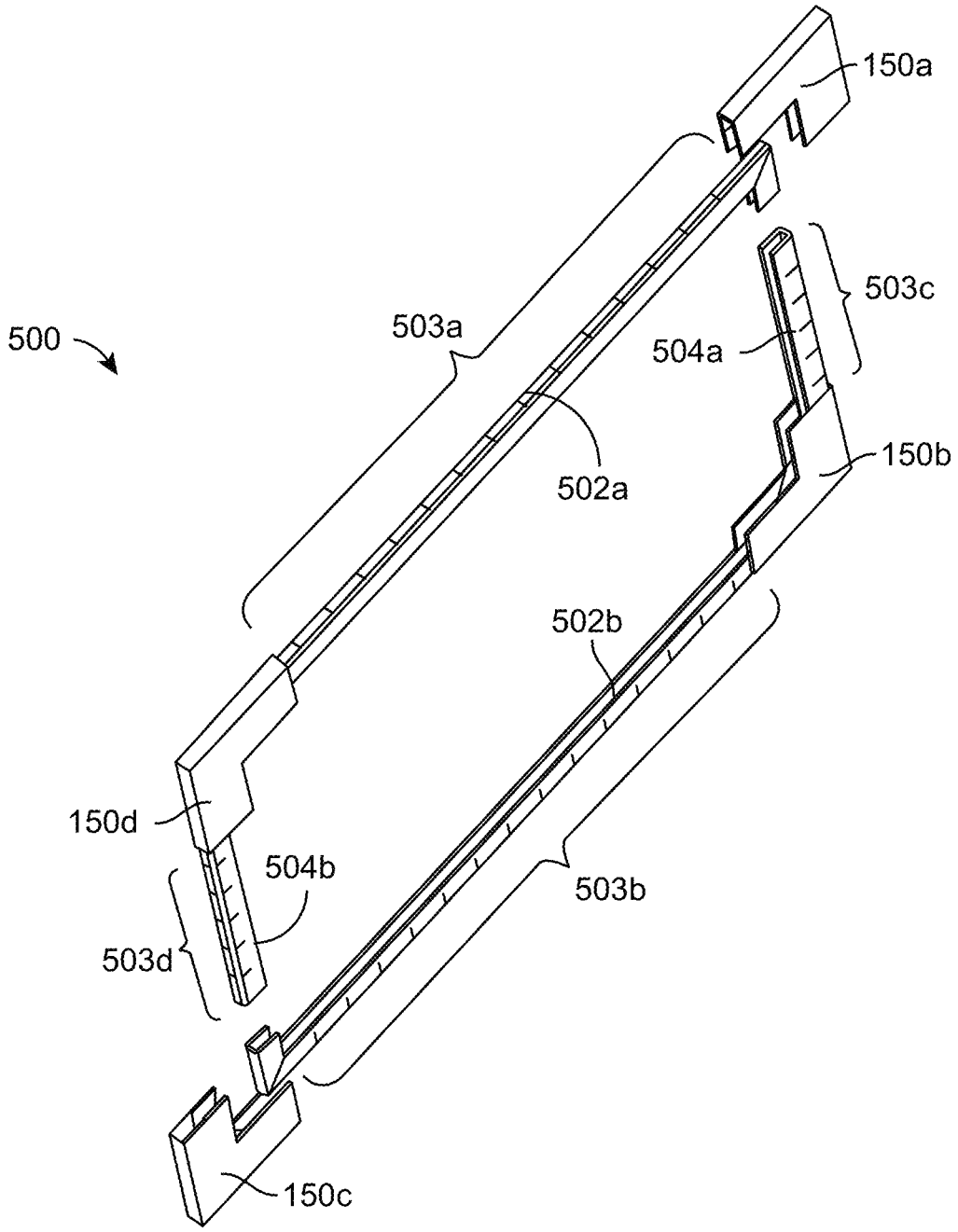
FIGS. 4A-4B are a set of perspective views of an embodiment of an assembly of protective material including four integrated corner locks for protecting a generally rectangular-shaped item.
Figure 4B:
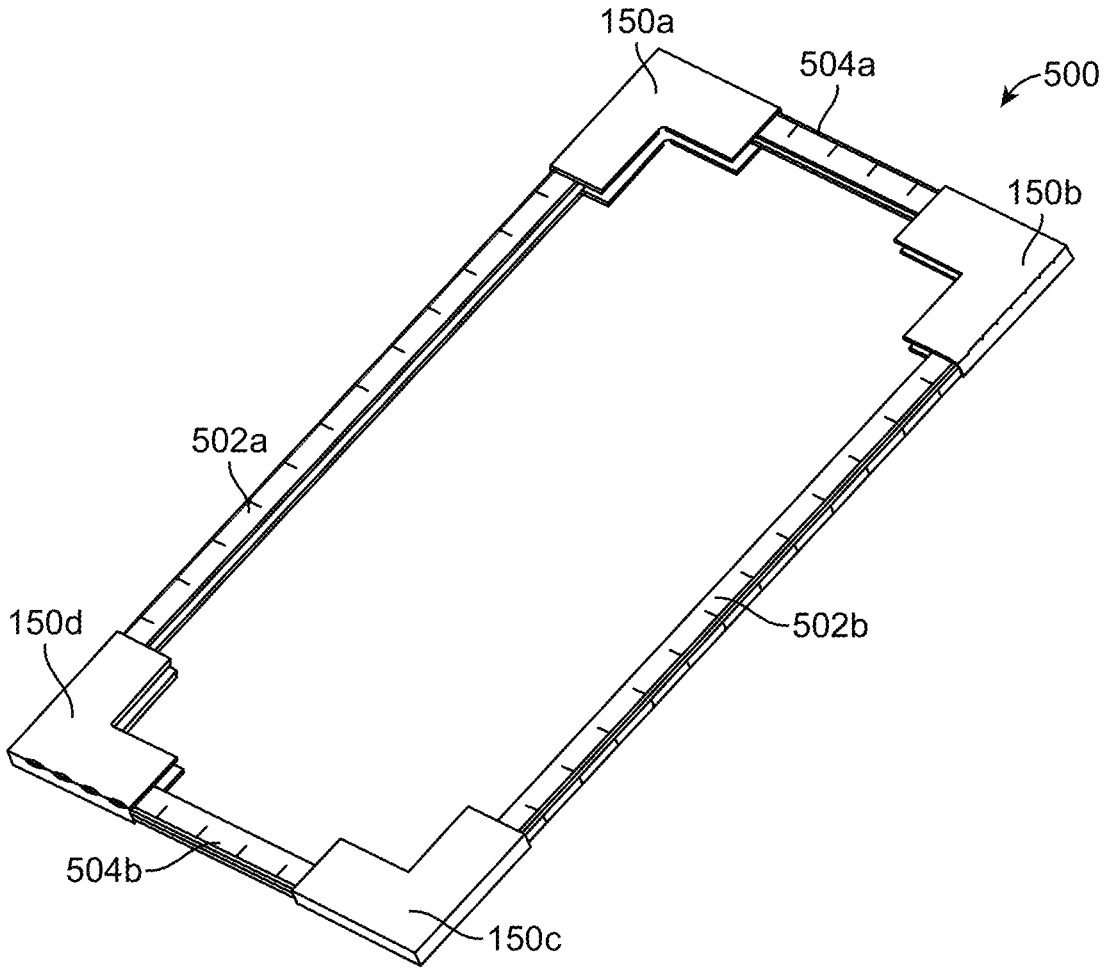

FIGS. 4A-4B depict perspective views that illustrate an embodiment of an assembly of protective material 500 that includes corner locks 150*a-d*, linear components 502*a,b*, forming long sides 503*a,b*, and linear components 504*a,b*, forming short sides 503*c,d*, connected for use as protective material. While FIGS. 4A-4B illustrate four corner locks 150*a-d*, two long sides 503*a,b*, and two short sides 503*c,d*, any suitable amount of corner locks and linear components can be used to form an assembly of protective material having any desirable shape and dimensions. For example, an assembly of protective material can be a hexagon, an octagon, or other suitable shapes including curved shapes. Similarly, though the corner lock 150 is shown as forming approximately a 90 degree angle, in some embodiments the corner lock 150 may form a greater angle or may form a smaller angle.

As illustrated, FIGS. 4A-4B include the corner locks 150*a-d*, the linear components 502*a,b*, and the linear components 504*a,b*. The linear component 502*a* and the linear component 504*a* can be inserted or otherwise positioned in the corner lock 150*a*. The linear component 502*b* and the linear component 504*a* can be inserted or otherwise positioned in the corner lock 150*b*. The linear component 502*b* and the linear component 504*b* can be inserted or otherwise positioned in the corner lock 150*c*. The linear component 502*a* and the linear component 504*b* can be inserted or otherwise positioned in the corner lock 150*d*. The linear components 502*a,b* and 504*a,b* can be inserted or otherwise positioned in the corner locks 150*a-d* via insertion slots (e.g., the insertion slots 302*a,b*) or via other suitable mechanisms. The corner locks 150*a-d* can apply retention forces (e.g., using the locking panels 122*a-d* or other suitable mechanisms) on the linear components and 504*a,b*. FIG. 4B illustrates one embodiment of a fully installed protective material assembly formed by the corner locks 150*a-d*, the linear components 502*a,b*, and the linear components 504*a,b*. In some embodiments, more or fewer corner locks may be used and more or fewer linear components may be used to form an assembly of protective material. For example, an assembly of protective material may have a non-rectangular shape, including but not limited to a hexagonal shape, an octagonal shape, or any other suitable shape.

While each side of a protective material assembly is described as being a linear component (e.g., the linear components 502*a,b*), the linear component can be formed by one or more smaller components (e.g., a chain of smaller components) that may be coupled together or decoupled apart from one another. In other words, the smaller components can be coupled together to form the linear component. In some embodiments, the linear component may be integrally formed by a plurality of smaller components, which may be decoupleable from one another. For example, a linear component may be formed of corrugated cardboard or another material and may include notches along a length of the linear component which may define the smaller components. A desired length of the linear component may be selected by decoupling one or more smaller components from a length of the linear component, for example by tearing, ripping or otherwise removing the one or more smaller components. Thus, a long length smaller components coupled together can be used to form one or more linear components of a desired length for use in an assembly of protective material, including forming linear components of different lengths. This can reduce costs by making the linear components easily customizable in length. In still yet other embodiments, the smaller components may be coupled together (as opposed to decoupled from one another) to form a desired length of the linear component, which may again provide for easily customizable linear components. The smaller components may be coupled together uses notches, adhesives, mating features, or other suitable features. In still yet other embodiments, the linear component may comprise a single piece of material of a desired length, in other words the linear component may be a single piece of material that is configured to neither coupled with nor be easily coupleable to any additional components for altering the length of the linear component. Additionally, the linear component can include or otherwise define a channel. For example, the channel can include a cross-sectional U-shape that can receive an item, for example a side of a door, a side of a window, a frame, or other suitable items, for aiding in the protection of the item during manufacturing, shipping, storage, or installation.

Figure 5:
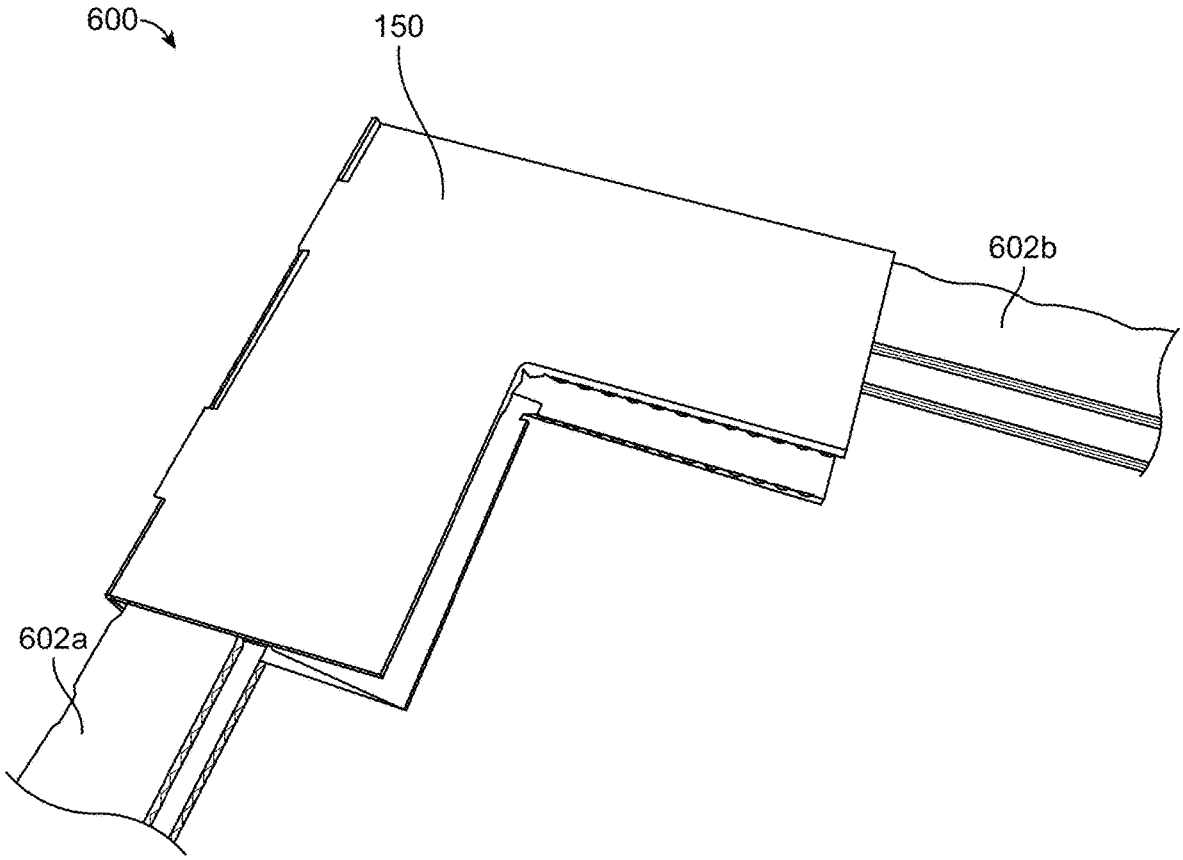
FIG. 5 is a perspective view of an embodiment of an assembly of protective material including a set of linear components inserted within a corner lock.

FIG. 5 depicts linear components inserted within a corner lock, for example the corner lock 150 formed from a blank, for example the unitary blank 100. As illustrated, linear components 602*a,b* can be inserted or otherwise positioned in the insertion slots (e.g., the insertion slots 302*a,b*) of the corner lock 150. The corner lock 150 can retain the linear components 602*a,b* at least in part via frictional engagement with the corner lock 150, including for example a force applied by the locking panels 122*a-d*, in some aspects. In some examples, the corner lock 150 can be installed on a large object, a heavy object, a fragile object, a valuable object, or other suitable object, and the corner lock 150, along with the linear components 602*a,b*, can prevent accidental or otherwise unwanted disassembly of the corner lock 150, the linear components 602*a,b*, or a combination thereof.

Figure 6:
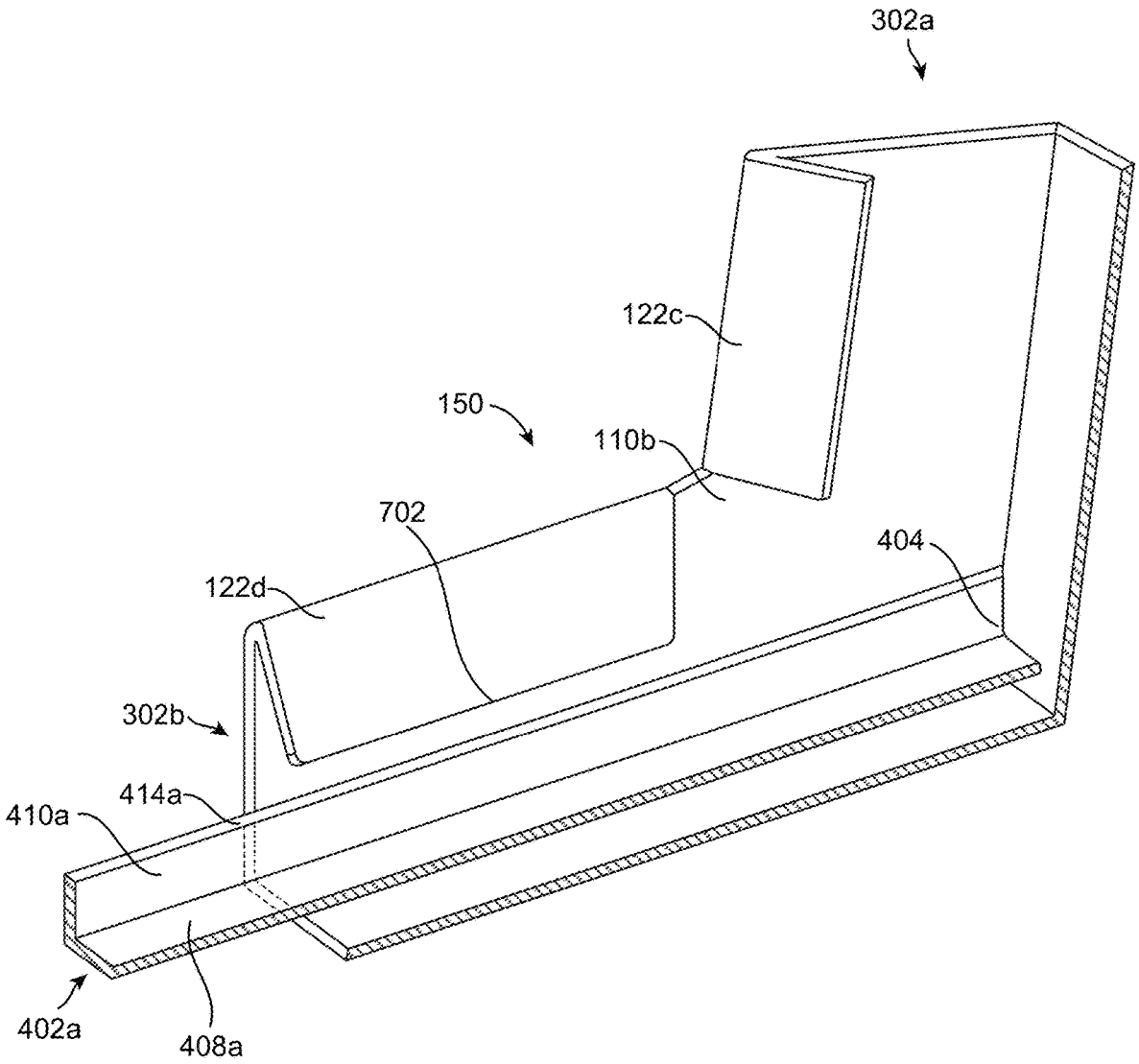
FIG. 6 is a cross-sectional perspective view of an embodiment of an assembly of protective material including a linear component inserted within a corner lock.

FIG. 6 depicts a simplified cross-sectional view of a linear component 402*a* inserted within a corner lock 150. As illustrated, FIG. 6 depicts the locking panel 122*d* of the corner lock 150. Additionally, FIG. 6 depicts the linear component 402*a* inserted into the corner lock 150 (e.g., within insertion slot 302*b*). In some embodiments the locking panel 122*d* can be biased or folded to angle in a direction towards a center of the insertion slot 302*b* such that that the locking panel 122*d* may aid in retaining a product positioned within the corner lock 150. The biasing of the locking panel 122*d* towards a product positioned within the corner lock 150 can aid in securing the corner lock 150 in place about the product which can increase the speed of packaging the product, can reduce the number of persons required to secure one or more corner locks 150 and linear component(s) about the product, and can thereby reduce costs associated with packaging and shipping the product. In some aspects, the biasing of the locking panel 122*d* optionally may aid in retaining the linear component 402*a*, in place. While not shown, locking panel 122*a* may similarly bias or fold to angle inwards within the insertion slot 302*b* such as to provide a frictional engagement (i.e. a compression force) between the locking panels 122*a,d* and the product. Similarly locking panels 122*b,c* may be sized and biased so as provide a frictional engagement (i.e. a compression force) between the locking panels 122*b,c* and the product.

In some aspects, the locking panel 122*d* may also aid in retaining the linear component 402*a* in place via frictional engagement between the locking panel 122*d* and the linear component 402*a*. For example, in various implementations, frictional engagement between a top edge 414*a* of the first side panel 410*a*, of the linear component 402*a* and a bottom edge 702 of the locking panel 122*d* may retain the linear component 402*a* within the insertion slot 302*b*. In further example, in various implementations, the locking panel 122*d* may contact (e.g. overlap) the first side 410*a* of the linear component 402*a*. The linear component 402*b* may also be sized to fit snuggly within the insertion slot 302*b* to aid in retaining the linear component 402*b* in place via frictional engagement with an inner surface of the body panel 110*b* that defines the insertion slot 302*b* of the corner lock 150.

FIG. 6 is simplified for ease of description. For example, while structure and function are described relative to insertion slot 302*b*, linear component 402*a*, and locking panel 122*d*, for example, similar structure and function may be provided for insertion slot 302*a*, linear component 402*b*, and locking panels 122*a-c*. Furthermore, the first end 404 of the linear component 402*a* is shown as extending linearly to the corner of the corner lock 150 (e.g. the full depth of the insertion slot), it should be understood with reference to FIGS. 3A-3B, for example, that linear component 402*a* may be dimensioned and arranged in various configurations, such as to correspond with the dimensions and arrangement of linear component 402*b*, which may extend into insertion slot 302*a*.

Figure 7:
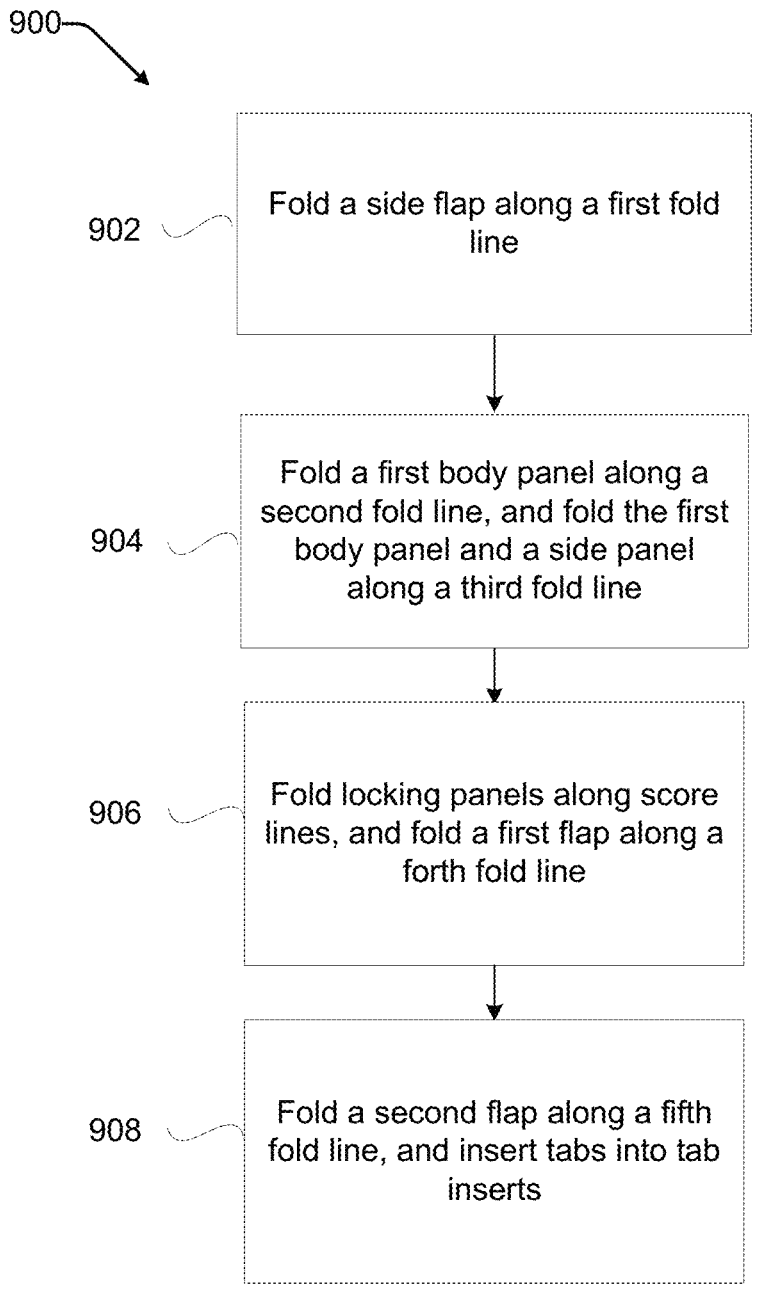
FIG. 7 is a flowchart of a process of assembling a packaging, including folding a unitary blank into a corner lock for use in a protective material.

FIG. 7 is a flowchart of a process 900 to assemble the unitary blank 100 into a corner lock 150 for use in an assembly of protective material (e.g., as illustrated in FIG. 4B). In some examples, the operations of the process 900 may follow the operations illustrated by FIGS. 2A-2F but need not do so. At block 902, the side flap 118 is folded along the fold line 120. The side flap 118 can be folded along the fold line 120 toward the side panel 114 and may form a substantially right angle with the side panel 114.

FIGS. 3A-7 depict various embodiments of the corner lock 150 and linear components (e.g., linear components 402*a,b*) having a substantially right angle (e.g., 90 degree angle) with respect to the corner lock 150. However, in other embodiments, the angle need not be 90 degrees. In some embodiments, the angle between the corner lock 150 and the linear components can be any suitable angle (e.g., less than 90 degrees or greater than 90 degrees).

At block 904, the body panel 110*b* is folded along the fold line 116*b*, and the body panel 110*b* and the side panel 114 are folded along the fold line 116*a*. In some examples, the described folds may be performed along the fold line 116*b* and then along the fold line 116*a* but may be performed in the opposite order. Subsequent to performing the folds along the fold lines 116*a,b*, the body panel 110*b* may be positioned opposite the body panel 110*a*.

At block 906, the locking panels 122*a-d* are folded along the score lines 124*a-h*, and the flap 104*b* is folded along the fold line 112*b*. In some examples, the locking panel 122*a* can be folded along the score lines 124*a,b*, the locking panel 122*b* can be folded along the score lines 124*c,d*, the locking panel 122*c* can be folded along the score lines 124*e-f*, and the locking panel 122*d* can be folded along the score lines 124*g-h*. Subsequent to folding the locking panels 122*a-d*, the locking panel 122*a* can be positioned opposite the locking panel 122*d*, and the locking panel 122*b* may be positioned opposite the locking panel 122*c*. Additionally, the flap 104*b* can be folded along the fold line 112*b* for opening the tab inserts 108*a,b* to receive the tabs 102*a,b*.

At block 908, the flap 104*a* is folded along the fold line 112*a*, and the tabs 102*a,b* are folded along the fold lines 106*a,b*, respectively, for inserting the tabs 102*a,b* into the tab inserts 108*a,b*, respectively. The flap 104*a* can be folded along the fold line 112*a* to position the flap 104*a* adjacent or otherwise proximate to the flap 104*b* and to position the tabs 102*a,b* adjacent or otherwise proximate to the tab inserts 108*a,b*. The tabs 102*a,b* can be inserted or otherwise positioned in the tab inserts 108*a,b*. Once the tabs 102*a,b* are positioned in the tab inserts 108*a,b* (e.g., subsequent to performing the above-described operations), the unitary blank 100 may be considered the corner lock 150 and may be used in various applications.

The process 900 may further include assembling a blank for forming the linear component (e.g. 402*a* or 402*b*). Forming the linear component 402*a,b* may include providing a linear component 402*a,b* having an elongated panel 408*a,b* with a width sized to be received within a slot (e.g. insertion slot 302*a,b*) within the corner lock 150. The linear component 402*a,b* may be provided with a first side panel (e.g. side panel 410*a,b*) foldably coupled to a first side of the elongated panel 408*a,b*, and a second side panel (e.g. side panel 412*a,b*) foldably coupled to a second side of the elongated panel 408*a,b*. The linear component 402*a,b* may include a corner section 416*a,b* which is foldably coupled at a first end (e.g. 404, 406).

The process 900 may include folding the first side panel 410*a,b* about the first side of the elongated panel 408*a,b*. The process 900 may include folding the second side panel 412*a,b* about the second side of the elongated panel 408*a,b*. The process 900 may include folding the corner section 416*a,b* to angle the corner section 416*a,b* relative to the remainder of the elongated panel 408*a,b* (e.g. at a crease or fold line in the elongated panel 408*a,b*).

The process 900 may include inserting linear component 402*a* within the insertion slot 302*b* within the corner lock 150, such that locking panels 122*a,d* retain the linear component 402*a* within the insertion slot 302*b*. The process 900 may include inserting linear component 402*b* within the insertion slot 302*a* within the corner lock 150, such that locking panels 122*b,c* retain the linear component 402*b* within the insertion slot 302*a*. Linear component 402*a* may be inserted into the insertion slot 302*b* prior to, after, or coincidentally with inserting linear component 402*b* into the insertion slot 302*a*. The order of inserting may depend, at least in part, on the geometry of the linear components 402*a,b*. For example if a linear component 402*a,b* includes a corner section 416*a,b* or is otherwise angled at the first end (404, 406), then it may be inserted prior to the other respective linear component 402*a,b*.

The process 900 may include assembling various other blanks to provide various assembled components of a packaging system. For example, the process 900 may include assembling additional blanks for forming a second corner lock, a third corner lock, a forth corner lock, and so forth. These additional corner locks may be assembled according to the same method as described for the blank for forming a corner lock above. In addition, the process may include assembling additional blanks for forming a second linear component, a third linear component, a forth linear component, and so forth. These additional corner locks may be assembled according to the same method as described for the blank for forming a linear component above.

As noted above, the design of the corner lock 150 and similar components allow an entity (e.g., a user) to form a protective material that can be efficiently installed on various objects (e.g., heavy objects, fragile objects, etc.). For example, less labor may be required to install the protective material, and the installed protective material may not accidentally disassemble or fall of off the various objects. In contrast, other (e.g., existing) protective materials that do not use the corner lock 150 may require excessive labor and may easily fall off or disassemble, especially during transit or packing/unpacking operations.

In some embodiments, an assembly of protective material can be assembled using one or two individuals. In contrast, other assemblies of protective material may require more than two individuals to assemble. For example, the assembly can include four corner locks 150 and various linear components, and the one or two individuals can individually install the corner locks 150 and linear components since the corner locks 150 apply retention pressure to aid in retaining the assembly as it is assembled. In contrast, the other assemblies require an individual to continuously apply the retention pressure to each corner lock 150 or linear component until the other assemblies are completely assembled. The retention force can be applied, in the assembly, by the corner locks 150 via frictional engagement associated with the locking flaps (e.g., locking panels 122*a-d*) and the item, the locking flaps and the linear components, and the linear components and the item.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

What is claimed is:

1. A packaging assembly comprising:

a blank for forming a corner lock in an assembled position, the blank comprising:

a first body panel foldably connected to a side panel, the first body panel comprising a first flap;

a second body panel foldably connected to the side panel, the second body panel comprising a second flap, wherein the first body panel and the second body panel are foldable about the side panel to form a slot within the corner lock in the assembled position;

a first locking panel foldably connected to the first body panel;

a second locking panel foldably connected to the first body panel;

a third locking panel foldably connected to the second body panel; and a fourth locking panel foldably connected to the second body panel; and an additional blank for forming a linear component in an assembled position, the additional blank comprising:

an elongated panel having a width sized and shaped for being received within the slot defined by the corner lock in the assembled position;

a first side panel foldably coupled to a first side of the elongated panel; and a corner section foldably coupled to a first end of the elongated panel, wherein the corner section is configured to be angled with respect to the elongated panel in an assembled position.

2. The packaging assembly of claim 1, wherein the blank further comprises:

a tab foldably connected to the first flap; and a tab insert positioned adjacent the second flap, the tab insert sized and shaped to receive the tab.

3. The packaging assembly of claim 1, wherein the blank further comprises:

an additional tab foldably connected to the first flap; and an additional tab insert positioned adjacent the second flap, the additional tab insert sized and shaped to receive the additional tab.

4. The packaging assembly of claim 1, wherein the first body panel is foldably connected to the side panel via a fold line.

5. The packaging assembly of claim 4, wherein the first locking panel is foldably connected to the first body panel via a score line.

6. The packaging assembly of claim 5, wherein the second body panel is foldably connected to the side panel via a second fold line, and wherein the third locking panel is foldably connected to the second body panel via a second score line.

7. A packaging assembly comprising:

a corner lock in an assembled position formed from a flat blank, the corner lock further comprising:

a first body panel foldably connected to a side panel, the first body panel comprising a first flap;

a second body panel foldably connected to the side panel, the second body panel comprising a second flap, wherein the first body panel and the second body panel are folded about the side panel to form a slot within the corner lock;

a first locking panel foldably connected to the first body panel;

a second locking panel foldably connected to the second body panel; and a linear component having an elongated panel having a width sized and shaped for being received within the slot defined by the corner lock in the assembled position;

wherein at least one of the first locking panel and the second locking panel are configured to be biased in a direction towards a center of the slot when the corner lock is in an assembled position, such that the linear component is in frictional engagement within the slot defined by the corner lock.

8. The packaging assembly of claim 7, wherein the linear component further comprises:

a first side panel foldably coupled to a first side of the elongated panel;

a second side panel foldably coupled to a second side of the elongated panel; and wherein a first end of the linear component is configured to be inserted within the slot of the corner lock.

9. The packaging assembly of claim 7, wherein the corner lock further comprises:

a tab foldably connected with the first flap; and a tab insert positioned adjacent the second flap, wherein the tab insert retains the tab to couple the first flap and the second flap.

10. The packaging assembly of claim 7, wherein the first locking panel and the second locking panel are folded with respect to the first body panel and the second body panel respectively to angle inward towards one another within the slot.

11. The packaging assembly of claim 10, further comprising a third locking panel foldably connected to the first body panel, and a fourth locking panel foldably connected to the second body panel, wherein the third locking panel and the fourth locking panel are folded with respect to the first body panel and the second body panel respectively to angle inward towards one another within the slot.

12. The packaging assembly of claim 11, wherein:

the angle of the first locking panel is in frictional engagement with the linear component within the slot; and the angle of the second locking panel is in frictional engagement with the linear component within the slot.

13. The packaging assembly of claim 8, wherein the linear component further comprises a corner section foldably coupled to a first end of the elongated panel, wherein the corner section is angled with respect to the elongated panel to correspond with a corner of the slot.

14. The packaging assembly of claim 8, further comprising:

a second corner lock in an assembled position formed from a third flat blank, the second corner lock further comprising:

a first body panel foldably connected to a side panel, the first body panel comprising a first flap;

a second body panel foldably connected to the side panel, the second body panel comprising a second flap, wherein the first body panel and the second body panel are folded about the side panel to form a slot within the corner lock;

a first locking panel foldably connected to the first body panel;

a second locking panel foldably connected to the first body panel;

a third locking panel foldably connected to the second body panel;

a fourth locking panel foldably connected to the second body panel; and wherein a second end of the linear component is configured to be inserted within the slot of the second corner lock.

15. The packaging assembly of claim 14, the second corner lock further comprises:

a tab foldably connected with the first flap; and a tab insert positioned adjacent the second flap, wherein the tab insert retains the tab to couple the first flap and the second flap.

16. The packaging assembly of claim 8, further comprising:

a second linear component in an assembled position formed from a third flat blank, the second linear component further comprising:

an elongated panel having a width sized to be received within the slot within the corner lock;

a first side panel foldably coupled to a first side of the elongated panel;

a second side panel foldably coupled to a second side of the elongated panel; and wherein a first end of the second linear component is configured to be inserted within the slot of the corner lock opposite the linear component, wherein the first end of the linear component couples with the first end of the second linear component within the slot.

17. The packaging assembly of claim 1, wherein the blank comprises a corrugated cardboard.

18. The packaging assembly of claim 1, wherein the blank comprises a plastic material.

19. The packaging assembly of claim 7, wherein at least one of the corner lock and the linear component comprises a corrugated cardboard.

20. The packaging assembly of claim 7, wherein each of the corner lock and the linear component comprises a corrugated cardboard.

21. The packaging assembly of claim 7, wherein at least one of the corner lock and the linear component comprises a plastic material.

22. The packaging assembly of claim 7, wherein each of the corner lock and the linear component comprises a plastic material.

* * * * *